US007906222B2

(12) United States Patent
Nakamura et al.

(10) Patent No.: US 7,906,222 B2
(45) Date of Patent: Mar. 15, 2011

(54) SLIDING MATERIAL AND A METHOD FOR ITS MANUFACTURE

(75) Inventors: Sinzo Nakamura, Mooka (JP); Naoki Sato, Tochigi (JP); Toshio Hakuto, Tochigi (JP)

(73) Assignee: Senju Metal Industry Co., Ltd., Tokyo (JP)

( * ) Notice: Subject to any disclaimer, the term of this patent is extended or adjusted under 35 U.S.C. 154(b) by 568 days.

(21) Appl. No.: 11/822,878

(22) Filed: Jul. 10, 2007

(65) Prior Publication Data

US 2008/0020215 A1 Jan. 24, 2008

(30) Foreign Application Priority Data

Jul. 11, 2006 (JP) ..... 2006-190077
Jul. 26, 2006 (JP) ..... 2006-203621

(51) Int. Cl.

| | |
|---|---|
| ***B32B 15/04*** | (2006.01) |
| ***B32B 15/18*** | (2006.01) |
| ***B32B 15/20*** | (2006.01) |
| ***B22F 1/02*** | (2006.01) |
| ***B22F 3/24*** | (2006.01) |
| ***B22F 7/00*** | (2006.01) |
| ***B22F 7/02*** | (2006.01) |
| ***B22F 7/06*** | (2006.01) |

(52) U.S. Cl. ..... 428/676; 428/674; 428/681; 419/12; 419/28; 419/35; 419/55

(58) Field of Classification Search ..... 428/674, 428/681, 675, 676, 677
See application file for complete search history.

(56) References Cited

FOREIGN PATENT DOCUMENTS

| | | | |
|---|---|---|---|
| JP | 09249924 | | 9/1997 |
| JP | 10330868 | | 12/1998 |
| JP | 2003194061 | | 7/2003 |
| JP | 2005163074 | | 6/2005 |
| JP | 2006-200024 | * | 8/2006 |

OTHER PUBLICATIONS

Machine Translation, Nakamura et al., JP 2006-200024, Aug. 2006.*

* cited by examiner

*Primary Examiner* — Michael La Villa
(74) *Attorney, Agent, or Firm* — Michael Tobias

(57) ABSTRACT

A sliding material has a sintered layer formed atop a backing plate. The sintered layer contains 5-15 mass % of Bi nonuniformly distributed in a Cu—Sn alloy matrix consisting essentially of 8-12 mass % of Sn and a remainder of Cu. The sliding material can be manufactured by nonuniformly mixing Cu—Sn alloy powder and Bi powder, dispersing the mixed powder on a backing plate, and sintering the mixed powder to form a sintered layer on the backing plate. The sliding material does not undergo seizing and does not have separation of the sintered layer from the backing plate even when used in severe conditions such as in hydraulic equipment or construction equipment.

10 Claims, 4 Drawing Sheets

SLIDING MATERIAL AND A METHOD FOR ITS MANUFACTURE

BACKGROUND OF THE INVENTION

This invention relates to a sliding material suitable for use in the manufacture of sliding parts such as those used in automobiles, industrial machines, and construction equipment. In particular, it relates to a lead-free sliding material and a method for its manufacture.

Moving parts of automobiles, industrial equipment, and construction equipment are often slidably supported by members which will be collectively referred to as sliding parts. Examples of such sliding parts are plain bearings which support rotating shafts in automobiles, side plates for restraining the side surfaces of gears in gear pumps of hydraulic equipment, and cylinders, swash plates, and shoes of piston pumps.

When equipment having such sliding parts breaks down and becomes too expensive to repair or becomes old and can no longer be used as desired, it is usually discarded. In order to conserve natural resources, many of the materials forming the components of such equipment are recycled or recovered and reused. However, sliding parts of equipment are often incapable of being recycled and are instead disposed of by burial.

Sliding parts typically having a sliding surface comprising a Cu-based bearing alloy. Such an alloy does not have sufficient mechanical strength to form a sliding part by itself, and a sliding part formed entirely from such an alloy would be too expensive. Therefore, sliding parts usually further include a rigid backing plate, such as a steel plate, bonded to the bearing alloy layer. The backing plate provides the sliding part with mechanical strength, while the bearing alloy layer provides the sliding part with good sliding properties. The bearing alloy layer and the backing plate are metallically bonded to each other, so it is not possible to mechanically separate the bearing alloy layer from the backing plate and separately recover them. It is conceivable to melt a sliding part and recover the steel contained in the backing plate, but the resulting molten steel will contain large amounts of Pb, Cu, and Sn introduced into the steel from the bearing alloy layer. These elements are undesirable components of steel and are difficult to remove. Thus, sliding parts cannot be easily recycled, and they are usually disposed of by burial as industrial waste.

From long in the past, lead bronze (referred to for short as LBC3 and having the composition Cu-10Sn-10Pb) has been frequently used as a Cu-based bearing alloy for sliding parts. Lead bronze contains lead dispersed in a Cu—Sn alloy matrix. The hard Cu—Sn alloy matrix can support a member being slidably supported by a sliding part (referred to below as "the opposing member") without wearing, and the lead spreads as a thin layer on the surface of the opposing member and provides good sliding properties by acting as a lubricating oil. Lead bronze is inexpensive and has good sliding properties, and for this reason it has been used in all types of sliding parts.

However, if sliding parts containing lead bronze are disposed of by burial in landfills and are contacted by so-called acid rain, the lead present in the lead bronze may be dissolved out by the acid rain and pollute underground water. If underground water containing lead is ingested by humans or livestock over a long period of time, the lead accumulates within the body and eventually cause lead poisoning. Therefore, the use of lead is now being regulated on a worldwide scale. In order to comply with such regulations, there is a strong demand in industries using sliding parts for a bearing alloy which does not contain lead.

Cu—Sn—Bi sliding alloys having Sn and Bi added to a copper base have been proposed as lead-free sliding alloys. In such sliding alloys, Bi performs the same function as Pb in conventional lead bronze, i.e., it forms a thin film covering the surface of the opposing member and acts as a lubricating oil to provide good sliding properties.

There have been a number of disclosures of bearing alloys containing Cu, Sn, and Bi. For example, JP H9-249924-A1 discloses a copper alloy and sliding bearing in which any of Ag, Sn, Sb, In, Mn, Fe, Bi, Zn, Ni, and Cr is contained in solid solution in a Cu matrix. JP H10-330868-A1 discloses a copper-based sintered alloy containing 5-50 mass % of Bi in a copper phase. JP 2003-194061-A1 discloses a copper-based sintered sliding material in which 1-11 mass % of Sn and at most 25 mass % of Bi are contained in a Cu base. JP 2005-163074-A1 discloses a Cu—Sn—Bi based sliding material in which Bi derived from an Sn—Bi alloy powder is uniformly distributed in a powder mixture, the mixed powder is dispersed on a steel plate, and then sintering is performed. In each of these publications, Bi is uniformly dispersed in a copper-based matrix.

In construction equipment and hydraulic pumps operating under a high load and at high speeds, lubricating oil is supplied to the sliding surfaces of sliding parts. A sliding part made from a conventional copper-based sliding material in which a Cu—Sn—Bi alloy is bonded to a steel plate does not exhibit a sufficient lubricating effect even when used with a lubricating oil, and of course it can not be used in a dry state without a lubricating oil.

In general, with sliding parts intended for use in a lubricated state, lubricating oil must always be present in a prescribed amount on a sliding surface of the sliding part. In order to ensure the presence of oil during operation of the sliding part, oil grooves for storing lubricating oil are normally formed in the sliding surface. Oil grooves typically have the shape of an elongated curve or a hemispherical shape. Oil grooves are usually formed in a sliding part by machining or pressing of the surface of the bearing alloy layer of the sliding material.

However, when an oil groove is formed in a bearing alloy layer, the thickness of the bearing alloy layer is reduced where the oil grooves are formed, and the reduced thickness decreases the bonding strength between the bearing alloy layer and the backing plate. As a result, in severe conditions of use, the bearing alloy layer sometimes peels off of the backing plate. If an oil groove is formed by press working, the portion of the sliding part where the oil groove is formed undergoes work hardening, which can be an impediment to subsequent working of the sliding material. For example, when the sliding material is to be formed into a cylindrical bearing, work hardening resulting from pressing can make it impossible to form the sliding material into a perfect cylinder.

SUMMARY OF THE INVENTION

This invention overcomes the drawbacks of existing Cu-based sliding materials and provides a sliding material which can exhibit excellent sliding properties not only when used with a lubricating oil but also when used in a dry (unlubricated) state.

If Bi is present in elemental form in the surface of a sliding material, the Bi acts as a solid lubricant. In addition, if Bi in the surface of the sliding material adheres to an opposing member and is pulled out of the surface, a large number of minute depressions are formed in the surface where the Bi was pulled out. If lubricating oil can accumulate in the depressions, the depressions can serve the same function as oil grooves. As a result, it becomes unnecessary to provide oil grooves in the surface of the sliding material sliding layer, thereby making it possible to avoid the problems associated with machining and pressing such as peeling and work hardening.

However, because Bi particles are extremely small, the depressions which are formed in the surface of a sliding material when Bi is detached from the layer are also extremely small. When Bi is uniformly distributed in the surface of a sliding material, it is difficult for the minute depressions to hold sufficient oil to provide satisfactory lubricating properties.

The present inventors discovered that if Bi is nonuniformly distributed in the surface of a sliding material, the depressions which are formed in areas where Bi is detached from the surface when adhering to an opposing member can hold a larger amount of oil compared to the case in which Bi is uniformly distributed and can hold a sufficient amount of oil for lubricating the sliding material during operation of a sliding part. In addition, when the overall content of Sn and Bi in the sliding layer is suitably selected, the bonding strength between the sliding layer and a backing plate can be increased, and sliding properties can be obtained which are superior to those of a sliding layer made of LBC3 without the need for oil grooves.

Accordingly, according to one aspect, the present invention provides a sliding material comprising a backing plate and a sintered layer formed on the backing plate. The sintered layer comprises 5-15 mass % of elemental Bi nonuniformly distributed in a Cu—Sn alloy matrix which consists essentially of 8-12 mass % of Sn and a remainder of Cu.

The present invention also provides a method of manufacturing a sliding material in which the degree of nonuniform distribution of Bi is 1/3 to 3/9, the method comprising the following steps:

(i) a mixing step comprising mixing a Cu—Sn alloy powder consisting essentially of 8-12 mass % of Sn and a remainder of Cu with Bi powder to obtain a nonuniform mixed powder containing 5-15 mass % of Bi in which Bi particles are nonuniformly distributed;

(ii) a dispersing step comprising dispersing the nonuniform mixed powder on a backing plate to form a layer of the nonuniform mixed powder on the backing plate;

(iii) a first sintering step comprising heating the nonuniform mixed powder and the backing plate to sinter the nonuniform mixed powder to the backing plate and sinter the particles of the nonuniform mixed powder to each other to form a multilayer material including a sintered layer in which Bi is nonuniformly distributed atop the backing plate;

(iv) a first pressing step comprising pressing the multilayer material to densify the sintered layer;

(v) a second sintering step comprising heating the multilayer material in order to reduce the hardness of the backing plate which was work hardened by the first pressing step and to further sinter the densified sintered layer; and (vi) a second pressing step comprising pressing the resulting multilayer material after the second sintering step.

A nonuniform distribution of Bi occurs when there is at least one rectangular region measuring 3 mm×27 mm on the surface of the sintered layer having the property that when this region is divided into nine rectangular subregions each measuring 1 mm×9 mm, the overall Bi content of the sintered layer in at least one and at most three of the nine subregions is at most 3 mass %.

In the present specification, the expression "the degree of nonuniform distribution of Bi" in a sintered layer means the number of the above-described subregions measuring 1 mm×9 mm in which the Bi content is at most 3 mass % out of the nine subregions in the above-described rectangular region measuring 3 mm×27 mm. A degree of nonuniform distribution of Bi of 1/9 to 3/9 means that at least one and at most three of the nine subregions contain at most 3 mass % of Bi.

The expression "nonuniform mixed powder" means that a sintered layer formed from the nonuniform mixed powder in the above-described manner exhibits a nonuniform distribution of Bi as defined above.

Thus, the degree of nonuniform distribution of Bi in the sintered layer formed in the first sintering step is 1/9 to 3/9. The degree of nonuniform distribution of Bi remains unchanged in the subsequent steps.

A sliding material according to the present invention is suitable for preparing sliding parts used in severe conditions and particularly for bearings for construction equipment and swash plates, side plates, and shoes of hydraulic equipment. However, a sliding material according to the present invention is not limited to the above-described sliding parts, and it can also be used in sliding parts of office equipment, home electrical appliances, and precision instruments, for example.

DESCRIPTION OF PREFERRED EMBODIMENTS

Figure 1:
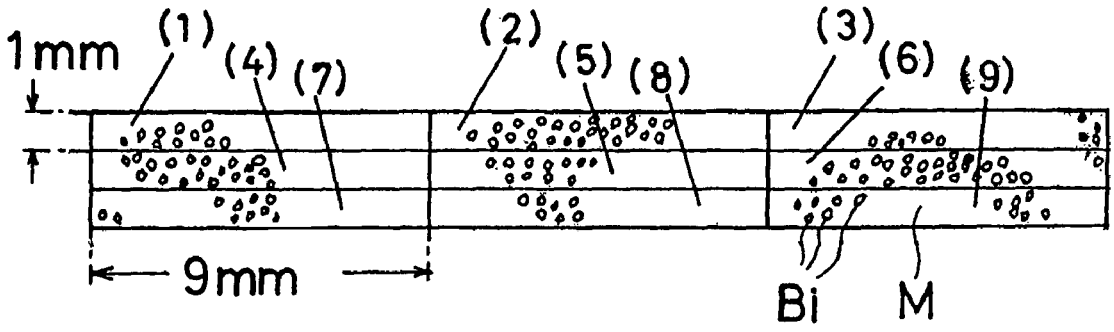
FIG. 1 is a schematic plan view of the surface of a sliding material according to the present invention, illustrating nonuniform distribution of Bi in a Cu—Sn alloy matrix.

The sintered layer of a sliding material according to the present invention has an overall Bi content of 5-15 mass %. The Bi is in elemental form dispersed in a Cu—Sn alloy matrix. If the overall Bi content of the sintered layer is less than 5%, the amount of depressions which are formed when Bi is detached from the sintered layer during use of a sliding part employing the sliding material is too small, and the sintered layer is unable to hold a sufficient amount of oil in the reservoirs formed by the depressions. In addition, when the overall Bi content is less than 5%, Bi cannot provide an adequate effect as a solid lubricant. On the other hand, if the overall Bi content in the sintered layer exceeds 15 mass %, the number of oil reservoirs formed by the depressions where Bi is detached from the surface of the sintered layer during use becomes too large, and an excessive amount of lubricating oil accumulates on the sliding surface. The excess oil is scattered to the periphery of the sliding material and may adhere to locations which do not require lubrication, causing them to become dirty. In the present invention, a preferred overall Bi content of the sintered layer is 7-9 mass %.

The Sn content of the sintered Cu—Sn alloy matrix of a sliding material according to the present invention is 8-12 mass %. If the Sn content is smaller than 8 mass %, the bonding strength between the particles of the alloy powder and between the alloy particles and the backing plate at the time of sintering of the mixed powder is inadequate, while if the Sn content exceeds 12 mass %, the Cu—Sn alloy matrix becomes too hard, and it can damage an opposing member during operation of a sliding part formed from the sliding material. A preferred Sn content of the alloy matrix is 9-11 mass %.

The nonuniformity of the distribution of Bi in the sintered layer of a sliding material according to the present invention can be measured in the following manner. A rectangular region measuring 3 mm×27 mm is arbitrarily selected on the surface of the sintered layer. This region is then divided into 9 rectangular subregions each measuring 1 mm×9 mm. The Bi content in each of the nine subregions is then analyzed using a microscope. Namely, the total area occupied by Bi particles in each of the subregions is measured by viewing the surface under a microscope, and based on the total area occupied by Bi particles, the mass percentage of Bi in each of the subregions can be calculated. The content of Bi can also be determined using chemical analysis of particles cut from each of the subregions.

The sintered layer is considered to have a nonuniform distribution of Bi if the surface of the sintered layer has at least one 3 mm×27 mm rectangular region in which at least one and at most three of the nine subregions have a Bi content of at most 3 mass %.

The reason why each subregion measures 1 mm×9 mm is because these dimensions are suitable to determine the degree of nonuniformity distribution of Bi for the purpose of the present invention, and are also convenient when measuring the bonding strength between the sintered layer and the backing plate.

If there is less than one subregion having a Bi content of at most 3 mass % in a 3 mm×27 mm region, Bi is too uniformly distributed, and the sintered layer cannot store a sufficient amount of lubricating oil in the depressions formed in the surface of the sintered layer when particles of Bi are detached. On the other hand, if more than three of the nine subregions in the region each have a Bi content of at most 3 mass %, the amount of oil which can accumulate in depressions formed in the surface of the sintered layer becomes too large.

The nonuniformity of distribution of Bi in the sintered layer can be adjusted in various ways. One way is by varying the length of time for which mixing is carried out when mixing a Sn—Cu alloy powder and a Bi powder to obtain a mixed powder. Another way is by changing the particle size of the Cu—Sn alloy powder and/or the Bi powder and utilizing the difference in apparent specific gravity between the different types of powder. In general, the longer the mixing time, the more uniform is the resulting powder mixture, and the smaller the difference in the apparent specific gravities of the different types of powders, the more uniform is the resulting powder mixture for a given mixing time.

FIG. 1 is a schematic plan view of the surface of the sintered layer of an example of a sliding material according to the present invention having a nonuniform distribution of Bi in a Cu—Sn alloy matrix (M). The rectangular grid represents a 3 mm×27 mm rectangular region for use in analyzing the nonuniformity of Bi distribution in the sintered layer. This region is divided into 9 rectangular subregions each measuring 1 mm×9 mm. The small hollow shapes on the surface of the sintered layer represent Bi particles. In this example, the Bi content in the nine subregions is 3 mass % in a first subregion (1), 10 mass % in a second subregion (2), 2 mass % in a third subregion (3), 9 mass % in a fourth subregion (4), 7 mass % in a fifth subregion (5), 15 mass % in a sixth subregion (6), 6 mass % in a seventh subregion (7), 5 mass % in an eighth subregion (8), and 8 mass % in a ninth subregion (9).

In this example, two of the nine subregions have a Bi content of at most 3 mass %, so the sliding material shown in FIG. 1 is considered to have a nonuniform distribution of Bi as defined in the present invention. The degree of nonuniform distribution of Bi is 2/9 in this example.

In a manufacturing method for a sliding material according to the present invention, Bi powder is mixed with a Cu—Sn alloy powder so as to be nonuniformly distributed in the resulting mixture, and the mixture is dispersed on a backing plate and sintered. The bond between Cu and Sn is stronger than the bond between Bi and Cu or Sn. Therefore, at the sintering temperature, molten Bi does not bond with the Cu—Sn alloy and instead remains in the Cu—Sn matrix in unalloyed form, i.e., in elemental form.

The mixed powder formed by nonuniformly mixing a Cu—Sn alloy powder with Bi powder has the same composition of Cu, Sn, and Bi as the above-described sintered layer. Namely, it contains 5-15 mass % and preferably 7-9 mass % of Bi, and the Cu—Sn alloy powder consists essentially of 8-12 mass % and preferably 9-11 mass % of Sn and a remainder of Cu.

Mixing of the Cu—Sn alloy powder and the Bi powder to obtain a nonuniform mixture can be performed using any suitable mixing device. One example of a suitable mixing device is a conventional Y-shaped mixer. The mixing time required to obtain a suitable nonuniform distribution will depend upon various factors such as the mixing speed and the apparent specific gravity of the different powders. A suitable mixing time can be easily determined by experiment.

After mixing, the mixed powder is dispersed on a backing plate, and a first sintering step is carried out. The sintering temperature in the first sintering step is selected such that the Cu—Sn alloy powder does not completely melt but such that the Cu—Sn alloy powder particles diffuse with each other and the Cu—Sn alloy powder particles mutually diffuse with the metallic atoms of the backing plate. A suitable sintering temperature is 750-850° C. and preferably 780-820° C. If the sintering temperature is lower than 750° C., diffusion between the alloy powder and the metal of the backing plate is inadequate, while if it exceeds 850° C., the Cu—Sn alloy powder ends up melting, and sintering can not take place. At the time of sintering, in order to carry out reduction of oxides of the alloy powder or the backing plate and adequately carry out metal bonding, sintering is preferably carried out in a reducing atmosphere. A mixture of hydrogen and nitrogen is an example of a suitable reducing atmosphere.

The material forming the backing plate can be selected in accordance with the intended use of a sliding part to be formed from the sliding material. Usually the backing plate is made of steel, but it can be made of other materials having sufficient strength for the intended use and capable of metallically bonding to the sintered layer. The backing plate may have dimensions close to the final dimensions of a sliding part, or it may be a larger member from which a plurality of sliding parts are formed by punching, cutting, or other method. Some examples of possible forms of the backing plate are plates, sheets, and continuous strips (collectively referred to here as "plate"). In examples of the present invention, the backing plate comprises a steel disc.

The sintered layer formed by the first sintering step is porous and not sufficiently strong to function adequately as a sliding layer, so after the first sintering step, a first pressing step is carried out to decrease the porosity (increase the density) of the sintered layer as well as to increase its mechanical strength.

During the first pressing step, the backing plate undergoes work hardening, which is an impediment to subsequent working of the backing plate. In addition, the first pressing step results in crushing of porous regions of the sintered layer, and in the crushed regions, the crushed portions may merely contact each other without being metallically bonded to each other. Therefore, after the first pressing step, a second sintering step is carried out to lower the hardness of the backing plate as well as to resinter the crushed portions and bond them to each other and increase the mechanical strength of the sintered layer. Heating in this second sintering step is preferably carried out in a reducing atmosphere. Like the first sintering temperature, the second sintering temperature is 750-850° C. and preferably 780-820° C.

If the surface of a sliding part does not have a suitable hardness, it will deform when a high load is applied to it, and the maximum permissible PV value of the sliding part will not be adequate. Therefore, a second pressing step is preferably carried out in order to increase the hardness of the sintered layer which was softened by the second sintering step. The sintered layer of the sliding material preferably has a hardness of at least Hv 70. In order to obtain this hardness after the second sintering step, pressing is carried out with a reduction in thickness of the sintered layer of at least 1%, usually about 1-5%. Examples of apparatuses which can be used for the first and second pressing steps are presses and rollers.

A sliding material which is obtained in this manner then undergoes finishing in order to form it into a sliding part of a desired shape. When the sliding part is a cylindrical bearing, the finishing comprises forming the sintered layer to a desired thickness on the backing plate and then forming the sliding material into a cylinder. If the sliding part is a flat member such as a side plate or a swash plate of a hydraulic pump, the sintered layer can be machined to a desired thickness and then polished if necessary to obtain a desired smoothness.

Sliding materials made of LBC3 have long been used without problems under severe conditions in sliding parts of industrial equipment. Accordingly, a sliding material according to the present invention preferably has sliding properties which are at least as good as those of LBC3.

The PV value is the product of the pressure applied to the surface of a sliding part by an opposing member in sliding contact with the sliding part and the speed of sliding when the temperature of the test piece reaches 200° C. in a dry state, i.e., in the absence of a lubricating oil as the pressure is increased gradually at a given sliding speed. The maximum permissible PV value is a commonly-used indicator of seizing resistance.

The maximum permissible PV value of LBC3 is 45 (kg/cm$^2$)(m/sec). In contrast, measurements showed that the maximum permissible PV value of a sliding material according to the present invention to be approximately 55-75 (kg/cm$^2$)(m/sec).

The bonding strength of a sliding material according to the present invention is the bonding strength between the sintered layer and the backing plate. The bonding strength can be determined by peeling the sintered layer off the backing plate by pressing a wedge-shaped chisel with a taper of 45° with a measured horizontal force against the interface between the sintered layer and the backing plate in a region measuring about 1 mm×about 9 mm. The bonding strength can be called "shear strength". The bonding strength or shear strength is equal to the force required to produce peeling divided by the area of the region. If the bonding strength is at least 10 kg/mm$^2$, the sliding material is adequate for use in a sliding part for construction equipment.

Below, the present invention will be explained more concretely by examples and comparative examples.

EXAMPLES

Examples 1-4 and Comparative Example 1

A sliding material according to the present invention was prepared by the following method, which will be described while referring to FIGS. 2-7.

Figure 2:
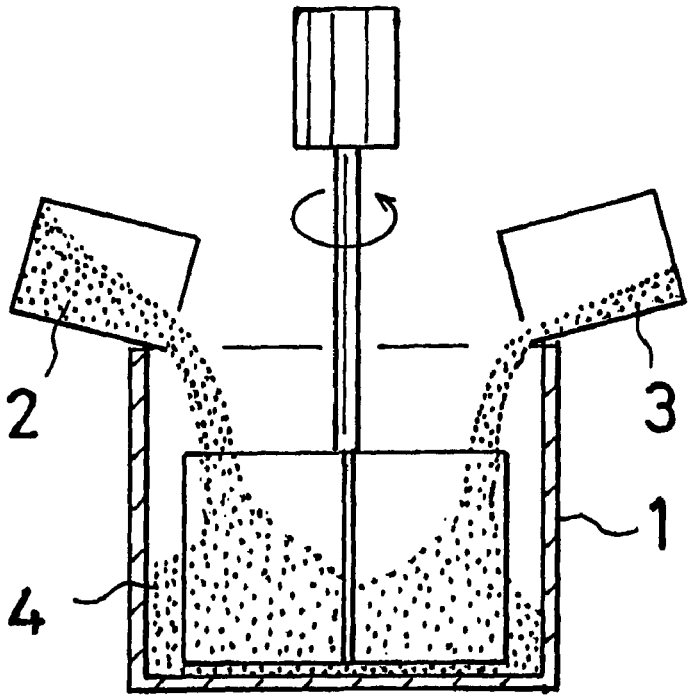
FIG. 2 is a schematic cross-sectional view of a mixer being used to prepare a nonuniform mixed powder in a mixing step of an example of a manufacturing method for a sliding material according to the present invention.

(i) Mixing step: As shown in FIG. 2, Cu—Sn powder 2 and Bi powder 3 were charged into a Y-shaped mixer 1 and mixed for 5 minutes to obtain a mixed powder 4. When this mixed powder was randomly sampled and the components were analyzed, Bi was found to be nonuniformly distributed in the powder. The composition of the Cu—Sn alloy and the content of Bi powder of the mixed powder for each example are shown in Table 1.

Figure 3:
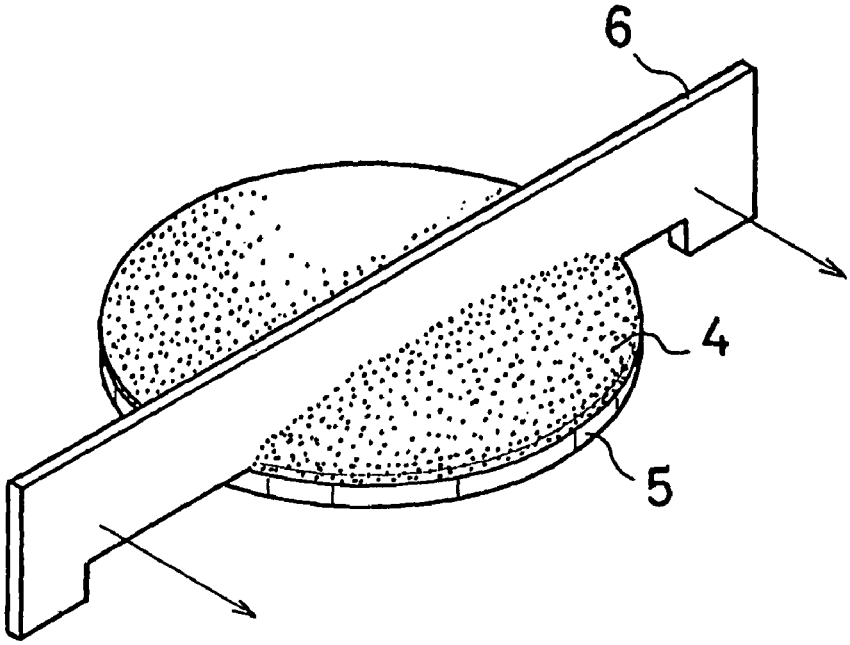
FIG. 3 is a schematic perspective view of a step of dispersing a nonuniform mixed powder on a backing plate in an example of a manufacturing method for a sliding material according to the present invention.

(ii) Dispersing step: As shown in FIG. 3, an excess amount of the mixed powder 4 was placed on a backing plate in the form of a disc-shaped steel plate 5 having a diameter of 90 mm and a thickness of 6 mm. The steel plate 5 was made of S45C carbon steel specified by JIS G 4051. The plate 5 was wiped with a squeegee 6 to remove excess mixed powder and disperse the powder on the plate 5 to a substantially uniform thickness of 2 mm.

Figure 4:
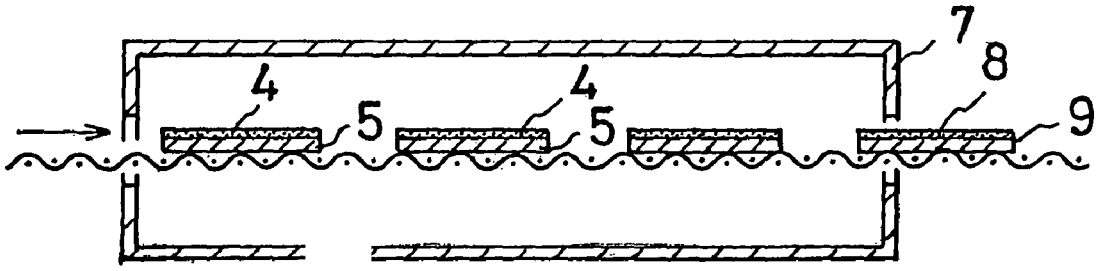
FIG. 4 is a schematic cross-sectional elevation of a furnace during a first sintering step in an example of a manufacturing method for a sliding material according to the present invention.

(iii) First sintering step: As shown in FIG. 4, the steel plate 5 on which the mixed powder 4 was dispersed was sintered at 760° C. in a sintering furnace 7 containing ammonia-decomposed gas as a reducing gas. The sintering caused metallic bonding to take place between the particles of Cu—Sn powder and between the Cu—Sn powder and the steel plate 5 to form a multilayer material 9 having a porous sintered layer 8 formed on the steel plate 5. At this time, the Bi did not alloy with the Cu—Sn powder and was nonuniformly distributed in the Cu—Sn alloy matrix in elemental form.

Figure 5:
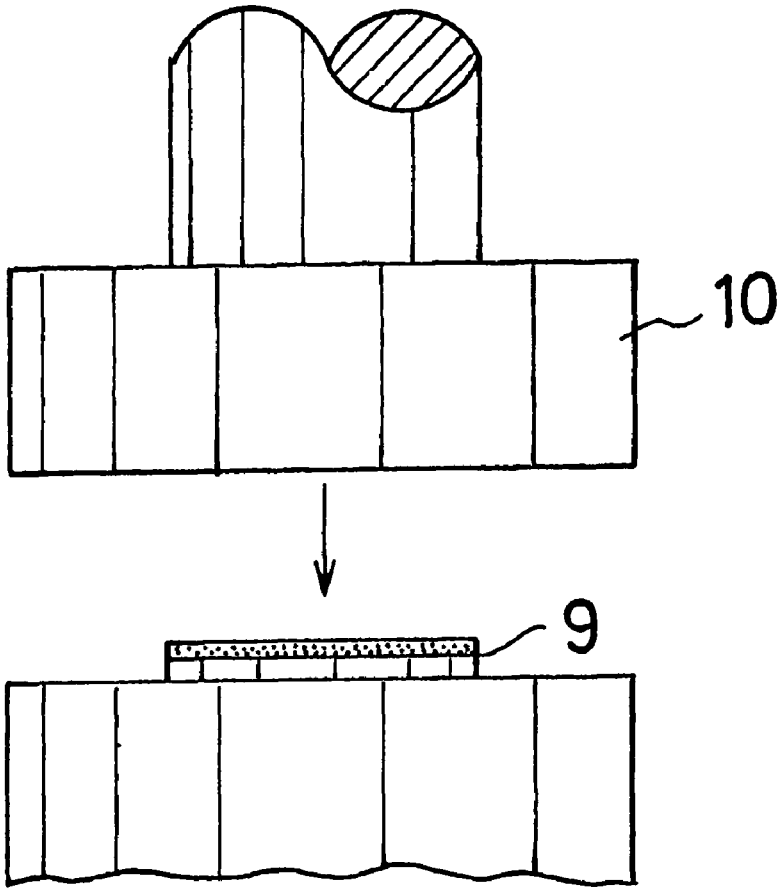
FIG. 5 is a schematic elevation of a press during a first pressing step in an example of a manufacturing method for a sliding material according to the present invention.

(iv) First pressing step: As shown in FIG. 5, the multilayer material 9 was pressed in a 600-ton press 10 to density the porous sintered layer.

Figure 6:
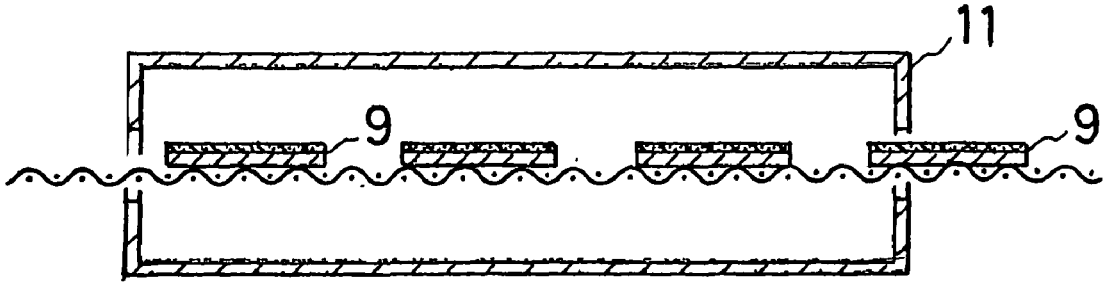
FIG. 6 is a schematic cross-sectional elevation of a furnace during a second sintering step in an example of a manufacturing method for a sliding material according to the present invention.

(v) Second sintering step: As shown in FIG. 6, the multilayer material 9 having a densified sintered layer was heated at 760° C. in a sintering furnace 11 to bond the crushed portions of the sintered layer to each other and lower the hardness of the work hardened steel plate.

Figure 7:
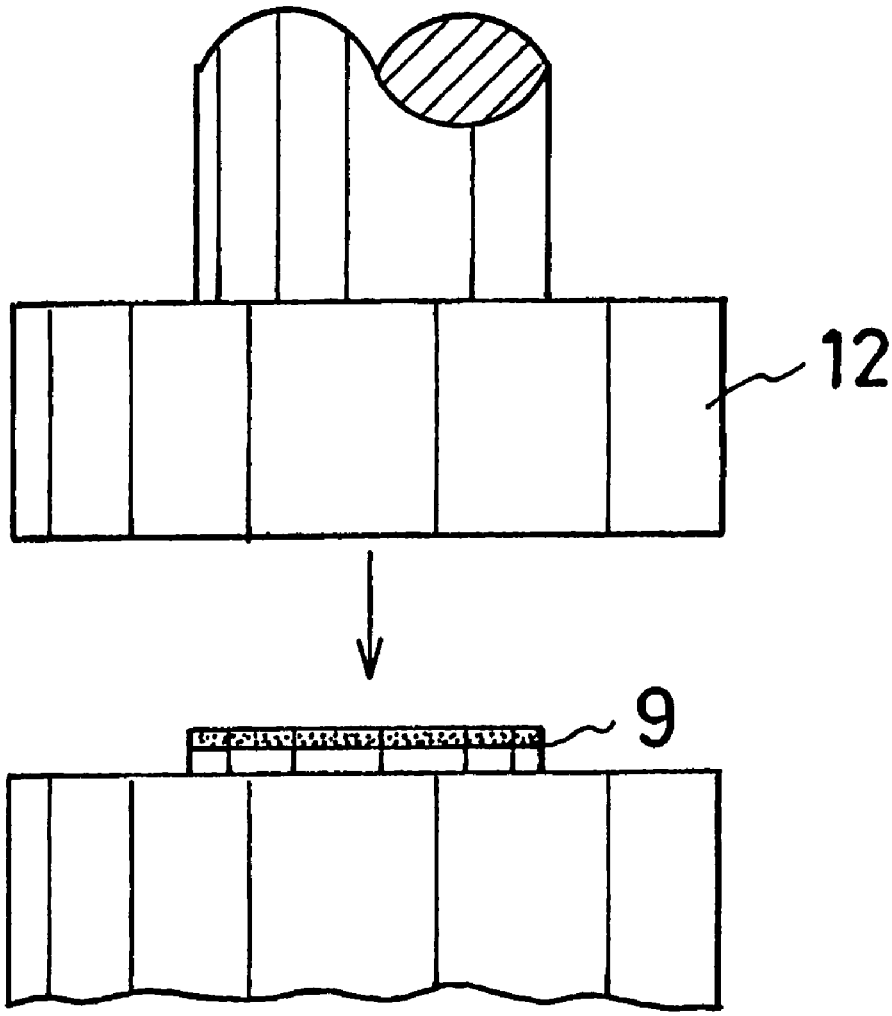
FIG. 7 is a schematic elevation of a press during a second pressing step in an example of a manufacturing method for a sliding material according to the present invention.

(vi) Second pressing step: As shown in FIG. 7, the multilayer material 9 which underwent the second sintering step was then pressed in a 600-ton press 12 to increase the hardness of the sintered layer to at least Hv 70.

The sintered layer of the sliding material obtained by the above-described steps was machined in a lathe to a final thickness, and then the surface of the sintered layer was polished using a precision lathe to smoothly finish it to obtain a swash plate for a hydraulic machine.

Comparative Example 1 was a commercially available bearing plate comprising LBC3.

A rectangular region measuring 3 mm×27 mm was arbitrarily selected on the surface of the sintered layer of the swash plate of each of Examples 1-4, and this region was divided into 9 rectangular subregions each measuring 1 mm×9 mm and arranged in the manner shown in FIG. 1. The Bi content of each subregion was determined in the manner described above by observation of the surface of the subregion under a microscope. For each of Examples 1-4, from 1 to 3 of the 9 subregions had a Bi content of at most 3 mass %, so the swash plates of these examples had a nonuniform Bi distribution as defined in the present invention.

The maximum permissible PV value and the shear strength, i.e., bonding strength in this specification of each swash plate were also determined in the manner described above.

The results of measurement are shown in Table 1.

TABLE 1

| | Mixed powder composition (mass %) | | | | Maximum | | Degree of | |
|---|---|---|---|---|---|---|---|---|
| | Cu—Sn alloy | | | | permissible PV value | Shear strength | nonuniform dispersion | |
| | Cu | Sn | Bi | Pb | ($kg/cm^2$)(m/sec) | ($kg/mm^2$) | of Bi | Comments |
| Ex. 1 | rem. | 10 | 8 | — | 75 | 25 | 2/9 | Present invention |
| Ex. 2 | rem. | 9 | 9 | — | 60 | 25 | 2/9 | Present invention |
| Ex. 3 | rem. | 8 | 5 | — | 55 | 25 | 3/9 | Present invention |
| Ex. 4 | rem. | 10 | 15 | — | 55 | 20 | 1/9 | Present invention |
| Comp. Ex. 1 | rem. | 10 | — | 10 | 45 | 20 | — | LBC3 |

As can be seen from this table, each of the examples of a sliding material according to the present invention had a significantly higher maximum permissible PV value and shear strength than did the comparative example employing LBC3.

Example 5 and Comparative Example 2

For Example 5, the method of Example 1 was repeated using the powders and backing plate described below to obtain a swash plate with a degree of nonuniform distribution of Bi of 2/9.

For Comparative Example 2, a swash plate was formed using the same powder and backing plate and substantially the same method as in Example 1 except that the mixing time was increased to 20 minutes. The resulting swash plate had a uniform distribution of Bi in a Cu—Sn matrix.

Composition of mixed powder:

92 mass % of Cu—Sn alloy powder (Cu-10Sn alloy)

8 mass % of Bi powder

Backing plate: 90 mm (diameter)×6 mm (thickness) disc made of S45C steel

The swash plates of Example 5, Comparative Example 1, and Comparative Example 2 were subjected to a wear test under the below-described conditions to determine the wear of the sintered layer.

The opposing member in the wear test was a ring made of SCR435 and having an outer diameter of 48 mm and an inner diameter of 40 mm. The surface pressure in the test was 0.7 $N/mm^2$, the circumferential speed was 11.5 m/sec, and the working fluid was mineral oil (ISO grade VG 46). The same test was also performed on the swash plate of Comparative Example 1 having a surface of LBC3.

The results of the wear test are shown in Table 2.

TABLE 2

| | Composition of sintered layer | No. of subregions containing ≦3 mass % Bi | Wear $mm^3/(N\text{-}m)$ | Comments |
|---|---|---|---|---|
| Example 5 | Cu—10Sn + 8Bi | 2 | $2 \times 10^{-7}$ | This invention |

TABLE 2-continued

| | Composition of sintered layer | No. of subregions containing ≦3 mass % Bi | Wear $mm^3/(N\text{-}m)$ | Comments |
|---|---|---|---|---|
| Comparative Example 2 | Cu—10Sn + 8Bi | 0 | $6 \times 10^{-7}$ | Comparative example |
| Comparative Example 1 | LBC3 | — | $6 \times 10^{-7}$ | Comparative example |

It can be seen that when a swash plate had a nonuniform distribution of Bi according to the present invention, sufficient oil could be held by the surface of the sliding part. As a result, the wear could be reduced to nearly 1/3 that of the comparative examples which did not have a nonuniform distribution of Bi (Comparative Example 2) or did not contain any Bi (Comparative Example 1).

What is claimed is:

1. A sliding material comprising a steel backing plate and a sintered layer formed atop the backing plate, the sintered layer comprising Bi nonuniformly dispersed in a Cu—Sn alloy matrix, the alloy consisting essentially of 8-12 mass % of Sn and a remainder of Cu, the sintered layer having a Bi content of 5-15 mass % and having a 3 mm×27 mm rectangular region on its surface comprising nine subregions each measuring 1 mm×9 mm, with at least one and at most two of the nine subregions having a Bi content of at most 3 mass %.

2. A sliding material as claimed in claim 1 wherein the Sn content of the Cu—Sn alloy is 9-11 mass %.

3. A sliding material as claimed in claim 1 wherein the Bi content of the sintered layer is 7-9 mass %.

4. A sliding material as claimed in claim 1 wherein the sintered layer has a hardness of at least Hv 70.

5. A sliding material as claimed in claim 1 wherein the sintered layer has a bonding strength to the backing plate of at least 10 kg/mm$^2$.

6. A sliding material as claimed in claim 1 wherein the Bi is in elemental form.

7. A sliding material as claimed in claim 1 wherein the sintered layer is formed by a method including mixing a Cu—Sn alloy and elemental Bi to obtain a nonuniform powder mixture, dispersing the powder mixture on the backing plate, and sintering the powder to the backing plate at a temperature of 750-850° C.

8. A method of manufacturing a sliding material comprising:

(i) a mixing step comprising mixing a Cu—Sn alloy powder with Bi powder to obtain a nonuniform mixed powder containing 5-15 mass % of Bi nonuniformly distributed in the mixed powder, the Cu—Sn alloy consisting essentially of 8-12 mass % of Sn and a remainder of Cu;

(ii) a dispersing step comprising dispersing the nonuniform mixed powder on a steel backing plate to form a layer of the nonuniform mixed powder on the backing plate;

(iii) a first sintering step comprising heating the nonuniform mixed powder and the backing plate at 750-850° C. to sinter the nonuniform mixed powder to the backing plate and sinter the particles of the nonuniform mixed powder to each other to form a multilayer material including a sintered layer in which Bi is nonuniformly distributed atop the backing plate such that the sintered layer has a 3 mm×27 mm rectangular region on its surface comprising nine subregions each measuring 1 mm×9 mm, with at least one and at most two of the nine subregions having a Bi content of at most 3 mass %;

(iv) a first pressing step comprising pressing the multilayer material to densify the sintered layer;

(v) a second sintering step comprising heating the multilayer material at 750-850° C. in order to reduce the hardness of the backing plate which was work hardened by the first pressing step and to further sinter the densified sintered layer; and (vi) a second pressing step comprising pressing the resulting multilayer material after the second sintering step.

9. A method as claimed in claim 8 wherein each of the first and second sintering steps is performed at 780-820° C.

10. A method as claimed in claim 8 wherein heating in each of the first and second sintering steps is performed in a reducing atmosphere.

* * * * *